US008541353B2

(12) United States Patent
Blizzard

(10) Patent No.: US 8,541,353 B2
(45) Date of Patent: Sep. 24, 2013

(54) CLEANER AND POLISH FORMULATION COMPRISING A POLYDIMETHYLSILOXANE/WAX MIXTURE

(76) Inventor: John D. Blizzard, Bay City, MI (US)

( * ) Notice: Subject to any disclaimer, the term of this patent is extended or adjusted under 35 U.S.C. 154(b) by 2 days.

(21) Appl. No.: 12/930,706

(22) Filed: Jan. 14, 2011

(65) Prior Publication Data

US 2011/0177991 A1 Jul. 21, 2011

Related U.S. Application Data

(60) Provisional application No. 61/336,209, filed on Jan. 19, 2010.

(51) Int. Cl.
*C11D 9/36* (2006.01)

(52) U.S. Cl.
USPC ..... 510/170; 510/171; 510/174; 510/208; 510/254; 510/343; 510/347; 510/466; 510/473

(58) Field of Classification Search
USPC ..... 510/170, 171, 174, 208, 254, 343, 510/347, 466, 473
See application file for complete search history.

(56) References Cited

U.S. PATENT DOCUMENTS

| | | | | |
|---|---|---|---|---|
| 7,115,254 | B1 * | 10/2006 | Brandt et al. | 424/70.11 |
| 2008/0063619 | A1 * | 3/2008 | Olsen et al. | 424/70.122 |
| 2008/0152608 | A1 * | 6/2008 | Cropper et al. | 424/66 |

OTHER PUBLICATIONS

Prototype Formulation for Exterior Trim Protection, Dow Corning trade publication, www.dowcorning.com/content/publishedlit/26-1578-01.pdf, copyright 2008.*

* cited by examiner

*Primary Examiner* — Charles Boyer

(57) ABSTRACT

A novel cleaner and polish formulation that is eco friendly, that is, it is formulated without alcohols, organic solvents and without normal cleaning and polishing components, for example, amine functional materials, that are undesirable with regard to the environment.

1 Claim, 1 Drawing Sheet

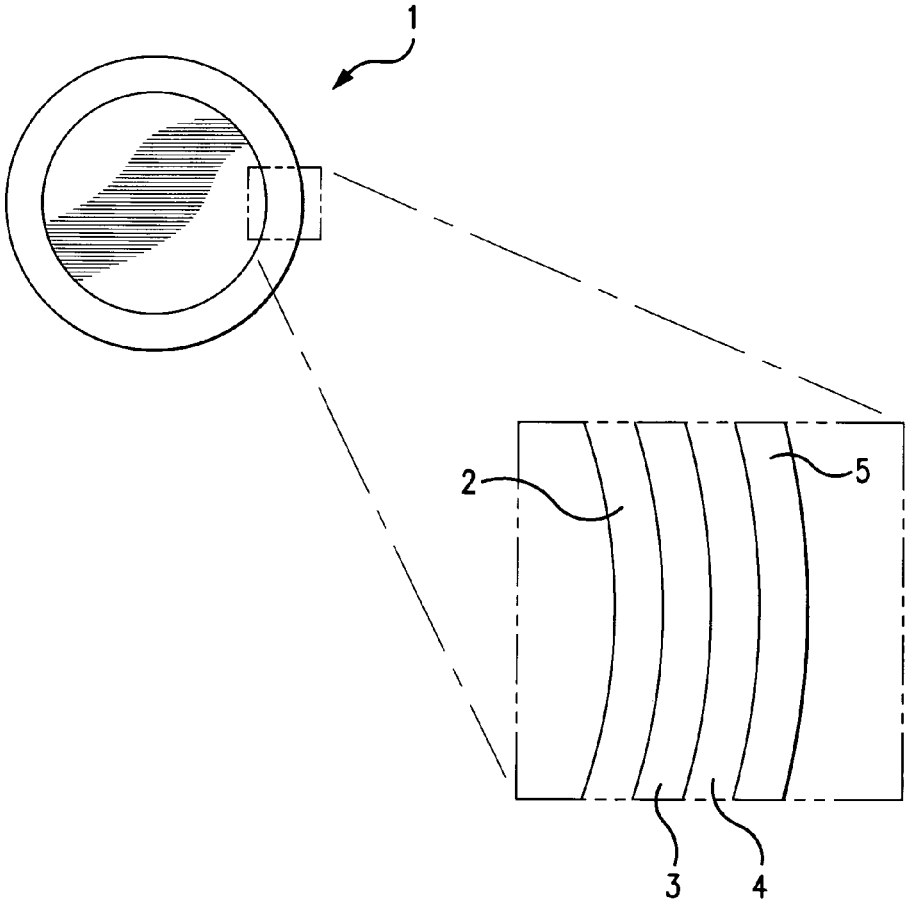
1
2
5
3
4

CLEANER AND POLISH FORMULATION COMPRISING A POLYDIMETHYLSILOXANE/WAX MIXTURE

This application claims priority from U.S. Provisional patent application Ser. No. 61/336,209 filed Jan. 19, 2010.

The invention disclosed and claimed herein deals with a novel cleaner and polish formulation that is eco friendly, that is, it is formulated without solvents and without normal cleaning and polishing components, for example, amine functional materials, that are undesirable with regard to the environment.

BACKGROUND OF THE INVENTION

The acronym "OPC" stands for organic photoconductor. The term "organic" portion means that the photoreceptor coating of the OPC was manufactured from carbon-based chemical compounds, specifically, photoconductive polymers synthesized from raw materials.

The most commonly utilized OPC drums in today's Japanese-designed copiers are manufactured to receive a negative charge. From innermost to outermost layer, they typically consist of an aluminum substrate, undercoat (or "blocking") layer UCL, charge generation layer CGL, and charge transport layer CTL. The applicant is not aware of any other eco friendly cleaner/polishes for such drums.

THE INVENTION

What is claimed and disclosed herein is a water-based cleaning and polishing product comprising a hydroxy endblocked polydimethylsiloxane having an average viscosity of about 20 to 90 cs at 25° C., a wax component selected from the group consisting of paraffin waxes, carnuba waxes and blends of paraffin waxes and carnuba waxes, at least one thickening agent and, water wherein the wax component is in a non-ionic or cationic emulsion form and the thickening agent addition to the formulation is pH controlled.

BRIEF DESCRIPTION OF THE DRAWINGS

FIG. 1 is a schematic end view of an OPC drum showing an expanded in size edge piece of the OPC drum.

DETAILED DESCRIPTION OF THE INVENTION

The material of the instant invention is a water based cleaning formulation free from alcohols, organic solvents and amines and is based on hydroxy endblocked polydimethylsiloxanes having an average viscosity of about 20 to 90 cs at 25° C. The siloxanes are available from several commercial sources. It is preferred to use the formulation as an emulsion and it is therefore preferred to use the siloxane already in emulsion form. Such emulsions are available commercially.

The second material of this invention is a wax component selected from the group consisting of paraffin waxes, carnuba waxes and blends of paraffin waxes and carnuba waxes. It is preferred to use the waxes in emulsion form and such materials are available commercially from several sources.

There is at least one thickening agent. Thickening agents can be any thickening agent that will in fact thicken the composition and preferred are cellulosic thickeners that are available commercially. The thickeners of this invention need to be added to the formulation using pH control. For example, the pH needs to be in the range of less than 7.0 before addition of the thickener, increased to greater than 7.0 after addition and mixing of the thickener, preferably a pH of 7.5 to 8.5.

Further, dyes, pigments, fragrances and the like can be added as long as they are soluble and compatible with the composition.

The compositions of this invention are highly useful for application to printing drums to refurbish the surfaces of the drums. The materials of this invention are not only eco friendly, but they do not interfere with the electrostatic charge, are not deleterious to the organic polymer surface of the drum, they prolong the life of the print drum, they are unaffected by the laser printing device and, they are transparent to light in spite of the absence of conventional organic solvents, amines and other organic materials.

Turning now to the treatment of the drums, and with reference to FIG. 1, there is shown an end view of a typical OPC drum 1 construction. As shown from innermost to outermost layer, they typically consist of an aluminum substrate 2, undercoat (or "blocking") layer UCL 3, charge generation layer CGL 4, and charge transport layer CTL 5.

The aluminum substrate 2 facilitates photoconductivity physically and electrically, but does not play an active role in the electro-photographic process. Its primary role is to provide structural and mechanical support, as well as an electrical path to ground.

The undercoat layer UCL 3 acts as an interface between the substrate and photoconductive layers, to provide adhesion and prevent undesirable charge "leakage" that can adversely affect copy quality. Like the substrate 2, it does not play an active role in the electro-photographic process, but provides an electrical path to ground. Common UCL materials include aluminum oxide, anodized aluminum, and various resistive polymers.

The charge generation layer CGL 4 is extremely thin, typically ranging from only 0.1 to 1.0 micron in thickness. Its color, which typically determines the apparent color of the OPC drum itself, depends on the specific materials it contains. The light-sensitivity of the CGL 4 is a critical factor in OPC performance, and can be a limiting factor for the copy speed at which an OPC can function effectively.

The charge transport layer CTL 5 is the outermost layer of an OPC drum, and is typically about 20 to 30 microns thick. It is essentially transparent, allowing light to pass directly through to the CGL 4. Just as the CGL 4 primarily determines an OPC's light-sensitivity, the CTL 5 primarily determines its charge acceptance and charge transport rate. As the outermost layer, the CTL 5 is contacted by toner, developer, paper, the drum cleaning blade (or brush), ozone, and other potentially abrasive and/or contaminating agents. Consequently, CTL 5 wear characteristics, such as durability and abrasion-resistance, are critical factors in the potential life of an OPC drum.

The photoreceptor is usually fabricated as a multilayered film on a conductive metallic substrate, and it is entirely made from organic materials. In this system the innermost charge the photo generation layer CGL 4 absorbs a photon and produces the charge which is subsequently injected into an upper charge transporting layer CTL 5. The CTL 5 has to accept the photo generated charge and transport it to the surface, neutralizing the surface charge and creating a latent image. The photoreceptor undergoes performance deterioration, often called fatigue, during the cycling by xerographic process and even during an exposure to ambient conditions. The CGL 4 is relatively stable, being fabricated usually from Phthalocyanines, one of the most stable known organic materials.

Thus, the schematic view of the cross section of the photoreceptor: Al, aluminum substrate 2; UCL 3 blocking layer (thickness, 0.1); CGL 4, charge photo generation layer (thickness, 0.1-1 mm); and charge transport layer (thickness 20-30 mm). protected by the upper CTL 5 layer. On the other hand, the CTL 5 is much more exposed to ambient factors, and it can undergo irreversible changes of two main origins: 1. mechanical wear caused by the contact of the surface with toner and/or with the mechanical components of the laser printer and 2. chemical changes of the material of the CTL 5 that can be induced either by the charge transport mechanism itself as a result of the periodic redox process on CTM molecules, or originating in corona or UV light induced photochemistry.

CGL 4 is a sub micrometer thin layer of phthalocyanine dye dispersed in a polymer binder, providing photoelectrical sensitivity in the near infrared spectral region. The CTL is formed by a 20-30 mm thick layer of polyester molecularly doped by a charge transporting material (CTM) with the addition of a fatigue control agent. Aryl amine substituted hydrazone is used as a CTM in these xerographic devices, which makes the CTL a hole transporting material.

For re-coating drums, a drum polish adds a protective layer that extends the life of the drum to several cycles and this invention is directed to that objective. It can be used in most laser printer OEM or long life drums (not CX drums). Results may vary depending on the type of toner used.

The polydimethylsiloxane fluid used herein is a milky white cationic emulsion of a intermediate viscosity polydimethylsiloxane fluid (approximately 60 cs at 25° C.) The polydimethylsiloxane fluid can be used as is and emulsified in the formulation, or it can be pre-manufactured and used as an already formulated emulsion. Used herein was DC 1665, obtained from the Dow Corning Corporation, Midland, Mich. The emulsion contained 55% silicone and had a relative low particle size.

743 wax is a nonionic paraffin wax emulsion. It is 32% wax in water available from Michelman Inc. as Michem® Lube 743.

155 wax is a nonionic wax emulsion blend of #1 carnuba and paraffin wax. It is 25% wax in water available from Michelman Inc. as Michem® Lube 155.

160 wax is a anionic wax emulsion blend of #1 carnuba wax. It is 25% wax in water available from Michelman Inc. as Michem® Lube 160.

Methocel J75M SN is a blend of methylcellulose and hydroxypropyl methylcellulose. It is available from the Dow Chemical Company, Midland, Mich.

Procedure:

The outer layer of the drum, the charge transport layer is composed of polymer resins and hydrozone. The CTL layer is typically worn from friction from the wiper blade and the paper media being printed. Friction is the enemy that thins the CTL layer and causes the back grounding or scratches that indicate a ruined drum. An OPC coating cream takes a two-pronged approach to halting the drum's destruction. First, it replenishes the worn-off CTL layer with a compatible photoconductive polymer resin which has the unique property of curing when exposed to the air. Second, it is blended with siloxane to produce a low-friction plating that will keep wear to a minimum.

The drum is first cleaned with 90% or 99% isopropyl alcohol and buffed dry with a soft rag. The coating was well shaken and applied in a small amount to a cotton round. The drum is held by the gears and the coating applied lengthwise back and forth from gear to gear, going around the drum twice to apply a thin, even coat.

The drum was set down for four minutes to dry. It can dry longer but not more than a half an hour or speckling may occur. When the coating was dry, a fresh cotton round was used to buff off the white haze that forms. The cotton round was turned over and a final polish was created with the clean side buffing to a high gloss. Most wear lines are filled in and any remaining scratches are frozen in place so as to not get any deeper.

In test printing, the first 5-10 pages may have a background. A font printout or two was run to get rid of the background. Several samples were prepared and tested. The formulations are shown in TABLE I.

Sample 1 is not within the scope of this invention and is for comparison basis against a prior art material. All components are added in parts.

TABLE I

| | Sample | | |
|---|---|---|---|
| | 1 | 2 | 3 |
| Water | 39.83 | 55.83 | 55.83 |
| Methocel J75M SN | 0.68 | 0.68 | 1.36 |
| Mix time | 30 Min. | 30 Min. | 30 Min. |
| Butyl Cellosolve | 16 | | |
| Siloxane as the emulsion | 6.67 | 6.67 | 6.67 |
| 743 Wax emulsion | 37.50 | 37.50 | 37.50 |

Results:

Test Method:

All samples were tested on one Daewon™ drum and one Alpha Chem™ drum (Commercial drums) by dividing the print surface using two drum samples. Daewon green drum and an Alpha Chem blue drum were used. The drums were coated with each formulation and stored for five days at ambient conditions with an attached PCR to emulate an assembled drum. After aging, the drums were installed in a cartridge to begin to test the printer.

During the Test:

After five days aging, the Alpha Chem blue drum had no apparent change, not showing any signs of chemical breakdown. The Daewon green drum on the other hand did show some damage of the coating. Sample 1 had begun to damage the drum outer layer, easily seen as a spider web pattern. When the Alpha Chem drum was tested in the printer, it showed some light prints and background in the beginning which after 500 pages the evenness and density improved. The background almost cleared up but was still noticeable.

When the Daewon drum was tested in the printer, it showed some light prints and heavy background in the beginning which after 500 pages the evenness and density improved. After 500 pages, the background almost cleared up completely. Two spider web patterns were found measuring 76 mm along the page. One was found in the center of the area of sample 1 and the second near the edge of sample 3.

Samples 1 and 3 damaged the Daewon drum while 2 did not. The Alpha Chem drum is more tolerable to all three coatings. The samples with the highest and lowest viscosity proved more challenging to clean off.

Several additional samples were prepared: See Table II for the formulations.

TABLE II

| | Sample | | | |
|---|---|---|---|---|
| | 22 | 2A | 2B | 2C |
| Water | 55.83 | 44.83 | 44.83 | 57.83 |
| Methocel J75M SN | 0.68 | 0.68 | 0.68 | 0.68 |

TABLE II-continued

| | Sample | | | |
|---|---|---|---|---|
| | 22 | 2A | 2B | 2C |
| Mix time | 30 Min. | 30 Min. | 30 Min. | 30 Min. |
| Siloxane as the emulsion | 6.67 | 6.67 | 6.67 | 13.34 |
| 743 Wax emulsion | 37.5 | | | 37.5 |
| 155 Wax emulsion | | 48 | | |
| 160 Wax emulsion | | | 48 | |

Test Method

Ten drum samples were evaluated, five Daewon green drums and five Alpha Chem blue drums. The drums were coated with each formulation and stored for five days at ambient conditions with an attached PCR to emulate an assembled drum. After aging, the drums were installed in a cartridge to begin to test the printer.

During the Test

After five days aging, the Alpha Chem blue drum had no apparent change, not showing any signs of chemical breakdown. The Daewon green drum on the other hand did show some damage of the coating. Samples 2A, 2B and 2C had begun to damage the drum outer layer, seen as random scratches on the surface.

TABLE 1-2

| HP 1022 printer with Alpha Chem Drum |
|---|
| Heavy background<br>White spots on black page<br>Solid black squares had uneven prints<br>White spots still noticeable at the end of the test |
| HP 1300 printer with Daewon drum |
| Medium amount of background at start<br>Heavy white spots that cleared after 8 pages of printing |

TABLE II 2A

| HP 1022 printer with Alpha Chem Drum |
|---|
| Heaviest background at the start<br>White spots on black page<br>Light/low density at the start (uneven prints)<br>90% of the coating residue cleared off within 4 pages printing |

TABLE II 2A-continued

| HP 1300 printer with Daewon drum |
|---|
| Heaviest background<br>Coating damage |

TABLE II 2B

| HP 1022 printer with Alpha Chem Drum |
|---|
| No background<br>Better density than current product<br>Minimal residue<br>Better that current product |
| HP 1300 printer with Daewon drum |
| Light background<br>OK density and evenness<br>Light coating damage<br>Coating damage insignificant at 300 pages printing |

TABLE II 2C

| HP 1022 printer with Alpha Chem Drum |
|---|
| Light background at the start<br>Uneven prints<br>85% of the residue comes off after 4 pages printing |
| HP 1300 printer with Daewon drum |
| No background<br>Better density than current product<br>Light coating damage |

What is claimed is:

1. A water-based cleaning and polishing product consisting essentially of:

A. a hydroxy endblocked polydimethylsiloxane having an average viscosity of about 20 to 90 cs at 25° C.;

B. a wax component selected from the group consisting of:

i. paraffin wax, ii. carnuba wax, and iii. blends of i and ii;

C. at least one thickening agent, and

D. water, wherein the wax component is in a non-ionic or cationic emulsion form and the thickening agent addition to the formulation is pH controlled.

* * * * *